US009027167B2

(12) United States Patent
Ronco

(10) Patent No.: US 9,027,167 B2
(45) Date of Patent: May 12, 2015

(54) ELASTICIZED STRUCTURE AND METHOD FOR MAKING AN ELASTICIZED STRUCTURE

(75) Inventor: Luigi Ronco, Molvena VI (IT)

(73) Assignee: Dainese S.p.A., Molvena (IT)

( * ) Notice: Subject to any disclaimer, the term of this patent is extended or adjusted under 35 U.S.C. 154(b) by 918 days.

(21) Appl. No.: 13/080,623

(22) Filed: Apr. 5, 2011

(65) Prior Publication Data

US 2011/0247129 A1 Oct. 13, 2011

(30) Foreign Application Priority Data

Apr. 7, 2010 (IT) ..... VR2010A0067

(51) Int. Cl.

| | |
|---|---|
| ***A41D 13/00*** | (2006.01) |
| ***A41D 31/02*** | (2006.01) |
| *A41D 13/02* | (2006.01) |
| *A41D 19/00* | (2006.01) |

(52) U.S. Cl.

CPC ..... *A41D 13/0002* (2013.01); *Y10T 428/24025* (2015.01); *A41D 13/02* (2013.01); *A41D 19/0006* (2013.01); *A41D 31/02* (2013.01); *A41D 2300/22* (2013.01); *A41D 2600/102* (2013.01)

(58) Field of Classification Search

CPC ..... A41D 19/00; A63B 71/148; A63B 71/146
USPC ..... 604/385.22
See application file for complete search history.

(56) References Cited

U.S. PATENT DOCUMENTS

| | | | | | |
|---|---|---|---|---|---|
| 1,594,979 | A | * | 8/1926 | Waldo | 112/414 |
| 1,597,042 | A | * | 8/1926 | Beebe | 2/162 |
| 1,606,899 | A | * | 11/1926 | Waldo | 112/414 |
| 1,606,900 | A | * | 11/1926 | Waldo | 112/475.09 |
| 1,639,332 | A | * | 8/1927 | Edwards | 101/32 |
| 2,059,747 | A | * | 11/1936 | Roberts | 36/51 |
| 2,066,428 | A | * | 1/1937 | Straus | 2/162 |
| 2,122,251 | A | * | 6/1938 | Hartmann | 156/148 |
| 2,205,356 | A | * | 6/1940 | Gruensfelder et al. | 36/51 |
| 2,205,577 | A | * | 6/1940 | Roberts | 36/45 |

(Continued)

FOREIGN PATENT DOCUMENTS

| | | |
|---|---|---|
| DE | 2339924 | 2/1975 |
| EP | 1728442 | 4/2010 |
| FR | 2416657 | 9/1979 |

OTHER PUBLICATIONS

English translation of DE2339924; Feb. 20, 1975.*

(Continued)

*Primary Examiner* — Andrew W Collins
(74) *Attorney, Agent, or Firm* — Steinfl & Bruno LLP

(57) ABSTRACT

The present disclosure refers to an elasticized structure and a method for making such an elasticized structure. The elasticized structure, includes a first piece and at least one second piece. The first piece is superimposed and fixed onto the second piece in at least a first fixing zone and at least a second fixing zone. The second piece is at least partially made of an elastic material and has an internal zone comprised between the first fixing zone and the second fixing zone. The elasticized structure is able to assume a tensioned position and a rest position. In the rest position, the first piece has a hump comprised between the first fixing zone and the second fixing zone and flat parts alongside said first fixing zone and said second fixing zone, respectively.

19 Claims, 9 Drawing Sheets

(56) References Cited

U.S. PATENT DOCUMENTS

| | | | | | |
|---|---|---|---|---|---|
| 2,217,377 | A | * | 10/1940 | Moore | 2/161.6 |
| 2,622,648 | A | * | 12/1952 | Ingram | 150/101 |
| 2,948,899 | A | * | 8/1960 | Allen | 2/94 |
| 3,394,408 | A | * | 7/1968 | Bush | 2/159 |
| 3,484,869 | A | * | 12/1969 | Cullinan, Jr. | 2/161.6 |
| RE31,538 | E | * | 3/1984 | Antonious | 2/160 |
| 5,359,950 | A | * | 11/1994 | Schellas | 112/417 |
| 5,423,089 | A | * | 6/1995 | Chun et al. | 2/161.2 |
| 5,606,745 | A | | 3/1997 | Gray | |
| 7,937,771 | B2 | * | 5/2011 | Mazzarolo | 2/69 |
| 2002/0156444 | A1 | * | 10/2002 | Otsubo | 604/385.3 |
| 2005/0210559 | A1 | * | 9/2005 | Gabriele | 2/69 |

OTHER PUBLICATIONS

Search Report for VR2010A000067 filed on Apr. 7, 2010 in the name of Dainese S.P.A.

Written Opinion VR2010A000067 filed on Apr. 7, 2010 in the name of Dainese S.P.A.

* cited by examiner

ELASTICIZED STRUCTURE AND METHOD FOR MAKING AN ELASTICIZED STRUCTURE

CROSS REFERENCE TO RELATED APPLICATIONS

The present application claims the priority of Italian patent application VR2010A000067 filed on Apr. 7, 2010, incorporated herein by reference in its entirety.

TECHNICAL FIELD

The present disclosure refers in general to an elasticized structure, i.e. to a structure (for example a textile or similar structure), made elastic by the use of a material having elastic properties.

The elasticized structure according to the present disclosure is suitable, in general, for use in coverings or protective devices for the human body or for articles in general, i.e., for example, in the clothing sector as a garment, or portion of a garment, in order to obtain an improved adherence to the body of a user; in the furniture sector as a covering, or portion of a covering, for example of armchairs, sofas or beds; in the automotive sector as a covering, or portion of covering, of seats and child seats, and similar applications where, in general, a structure, or a material, is made elastic so as to adhere effectively on a body underneath.

BACKGROUND

A method for making an elasticized structure envisages the following production steps:

- providing a leather piece;
- superimposing an elastic layer, in particular made of an elastic fabric, on the first piece, said layer having a smaller surface area than the leather piece;
- stretching, in the superimposed condition, the leather piece and the elastic layer on a support frame, wherein the elastic layer is elastically deformed before being fixed to the frame;
- forming a plurality of elongated seams, arranged very close side by side and parallel to each other, wherein each seam transversally connects the leather piece and the elastic layer;
- removing the leather piece and the elastic layer from the frame. At the moment of detachment from the frame, the elastic layer elastically returns into an undeformed condition and takes the leather piece along with it, owing to the constraint of the seams.

In practice, at the moment of sewing the elastic layer is totally deformed; after sewing and removal from the frame, each elastic layer portion comprised between two adjacent successive seams returns into an undeformed condition, taking the leather piece along with it and causing a corresponding wrinkling of the leather piece; therefore, there is the formation of a plurality of tight adjacent leather folds, or creases, in close contact each other and only separated by a respective seam.

In practice, when the leather piece and the elastic layer are released, an elasticized structure is obtained, wherein the leather piece has a wrinkled form caused by the elastic return of the elastic layer to which the piece is constrained.

This method may give rise to one or more drawbacks.

A first drawback lies in the fact that the leather piece must be properly thinned before the abovementioned processing, i.e. it must be properly worked to obtain a relatively small thickness in order to be easily "creasable", while still allowing pulling by the elastic layer at the moment of detachment from the frame, and thus be easily creased to form the adjacent folds.

The reduction in thickness of the leather piece is disadvantageous, in particular when the elasticized structure is used to make protective-type garments, such as motorcycle suits. In fact, the leather, that is located on an external side of the garment, having a reduced thickness, inevitably provides a limited protection for a user.

Moreover, a second drawback lies in the fact that the known method is not very versatile, not allowing the formation of wrinkles with a spread out arrangement or according to a design of one's choice.

A further drawback lies in the impossibility of modifying the elasticity of the structure, this being solely determined by the elasticity of the abovementioned layer.

A further drawback lies in the fact that the elastic layer has a significant impact on the weight of the elasticized structure, and an excessive weight is unfavorable when the elasticized structure is used in a clothing item.

BRIEF DESCRIPTION OF THE INVENTION

According to a first aspect of the disclosure, the elasticized structure includes a first piece and at least one second piece, said first piece being superimposed and fixed onto the second piece in at least a first fixing zone and at least a second fixing zone, wherein the second piece is at least partially made of an elastic material, said second piece having an internal zone comprised between the first fixing zone and the second fixing zone, wherein said elasticized structure is able to assume a tensioned position and a rest position, wherein, in said tensioned position, the first piece is in an at least partially tensioned condition and the internal zone of the second piece is in a condition of elastic deformation, and wherein, in said rest position, the first piece has a hump comprised between the first fixing zone and the second fixing zone, and parts which are flat, or without humps, alongside said first fixing zone and said second fixing zone, respectively.

According to a second aspect of the disclosure, an elasticized structure includes a first piece and at least one second piece, wherein said first piece is superimposed and fixed onto the second piece in at least a first fixing zone and at least a second fixing zone, wherein the second piece is at least partially made of an elastic material, said second piece having an internal zone comprised between the first fixing zone and the second fixing zone, wherein said elasticized structure is able to assume a rest position and a tensioned position, wherein, in said rest position, the second piece is undeformed and the first piece has a hump comprised between the first fixing zone and the second fixing zone and wherein, in said tensioned position, the first piece is in an at least partially tensioned condition and the second piece has an elastic deformation confined to the internal zone.

According to a third aspect of the disclosure, a method for making an elasticized structure, comprises the steps of

- providing a first piece and a layer made of an at least partially elastic material;
- stretching the layer until the layer assumes an elastically deformed condition;
- keeping the layer in a deformed condition, superimposing and joining together the first piece and the layer, so as to obtain a first fixing zone and a second fixing zone opposite to the first fixing zone, an internal zone being comprised between said first fixing zone and said second fixing zone;

cutting said layer alongside the first fixing zone and alongside the second fixing zone, externally to said internal zone, so as to obtain a second piece having a free edge projecting from the first fixing zone and a free edge projecting from the second fixing zone.

Further aspects of the present disclosure are defined in the dependent claims.

According to an aspect of the present disclosure, when the elasticized structure is in a tensioned position, only an internal zone of the second piece, i.e. the zone comprised between a first fixing zone and a second fixing zone, is elastically deformed. The elastic deformation is thus confined to this internal zone.

Therefore, the first piece, after release when stretching stops in the rest position, has a hump in the region of this internal zone, confined between the first fixing zone and the second fixing zone, and substantially flat parts, i.e. without humps, on the sides of said first fixing zone and said second fixing zone.

In other words, in the elasticized structure according to the present disclosure, the first piece has, in a rest position, a fold or protrusion, or hump only opposite the underlying internal zone of the second piece. On the other hand, directly alongside the fixing zones it is possible to avoid the presence of humps.

It is possible to have an elastic structure with non-consecutive, and also, optionally, irregular or irregularly distributed humps. In other words, it is possible to have in the elasticized structure a first piece having substantially isolated humps. This is obtained owing to the fact that the elastic deformation of the second piece is separated (confined to the above-mentioned internal zone) and independent from an elastic deformation of another adjacent second piece which is fixed in the same way to the first piece.

Therefore, it is possible to provide an elasticized structure wherein the first piece has folds or protrusions or humps which are isolated, and not successive, and which can be arranged at a distance from each other, not tightly together. In this way, if a first piece made of leather is used, it may have a relatively large thickness, suitable for use for protective purposes as required in the sector of sport clothing.

In one embodiment, each second piece has free or cut edge zones projecting externally from the first fixing zone and from the second fixing zone. In this embodiment the second piece, having free edges, is a single piece that can be obtained by cutting.

In further embodiments, an elasticized structure includes a plurality of single, structurally independent, second pieces.

According to some aspects of the present disclosure, the elasticized structure has an easily localizable elasticity, by means of each single second piece, i.e. a localized elasticity, distributed as needed in previously defined zones, or according to a pre-defined design for distribution of elastic zones.

Moreover, it is possible to obtain an elasticized structure having a pluri-directional elasticity; in fact, each second piece may have an elastic behavior different from another second piece.

The possibility of using the elasticized structure, for example as an insert, in a clothing item or in an accessory of a clothing item, allows localized adaptation of the clothing item or the accessory, also to very small parts, as, for example, in a glove in the region of the fingers of a hand. For example, a single second piece is located in the region of each finger of the glove.

Moreover, by distributing small second pieces in a garment, in a clothing item or in an accessory thereof, or in any article where the elasticized structure is used, there is the possibility of using a reduced amount of elastic material, with a significant reduction in weight.

By means of the distribution, according to needs, of the second elastic pieces it is also possible to obtain a localized removal of folds that form in specific points of a clothing item, such as a motorcycle suit or other covering.

In one embodiment, the first fixing zone and the second fixing zone are located along a closed line. This embodiment allows the above-mentioned internal zone subject to elastic deformation to be confined within this closed line, and at the same time allows a hump having a given desired profile, and thus a predefined design, to be obtained on the first piece, in a rest position. In fact, forming, for example, a circle-shaped fixing line, provides on the first piece a hump formed substantially as a circular dome, whereas a closed half-moon fixing line provides a hump formed as a half-moon.

In one embodiment, to favor fixing between the first piece and the second piece, each first fixing zone and/or second fixing zone includes a seam extending transversally between the first piece and the second piece.

Therefore, in the case of a loop-shaped closed fixing line there is a loop-shaped closed seam wherein opposite portions of the loop-shaped closed seam coincide with the first fixing zone and the second fixing zone.

Alternatively, the fixing zones are two opposite open lines, i.e. they are not connected to each other.

In one embodiment, the first piece is made of leather, which provides an adequate protection in the case of use of the elasticized structure in a motorcycle suit.

It is understood that the first piece can be made also of other fabrics, such as a non-woven fabric, or in a partially elastic fabric.

BRIEF DESCRIPTION OF DRAWINGS

Reference will be made to the figures of the annexed drawings, wherein.

DETAILED DESCRIPTION OF SEVERAL EMBODIMENTS OF THE INVENTION

Referring initially to the annexed figures, the reference number 1 denotes an elasticized structure according to the present disclosure.

Figure 5:
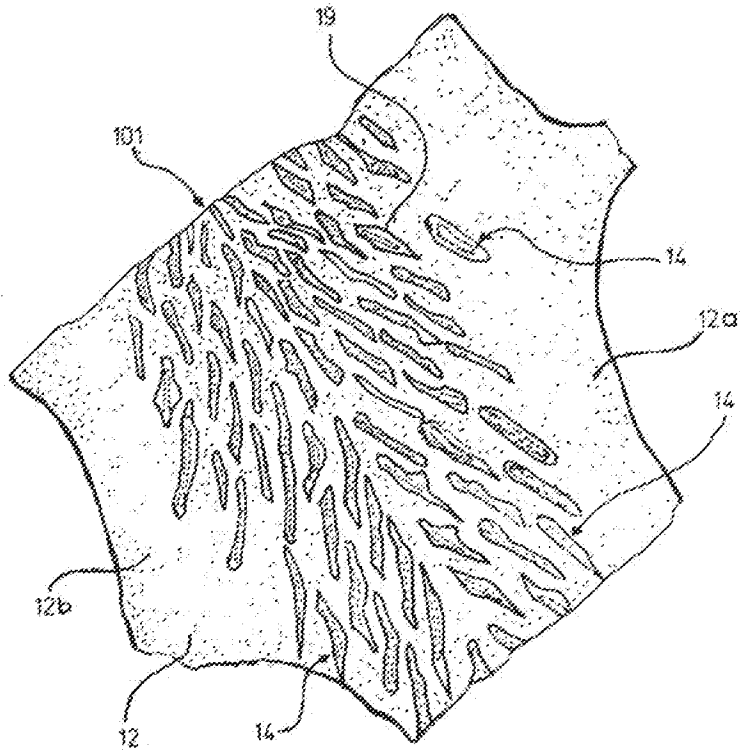
FIG. 5 shows a view, from the side of the second pieces, of the elasticized structure of FIG. 4.
Figure 4:
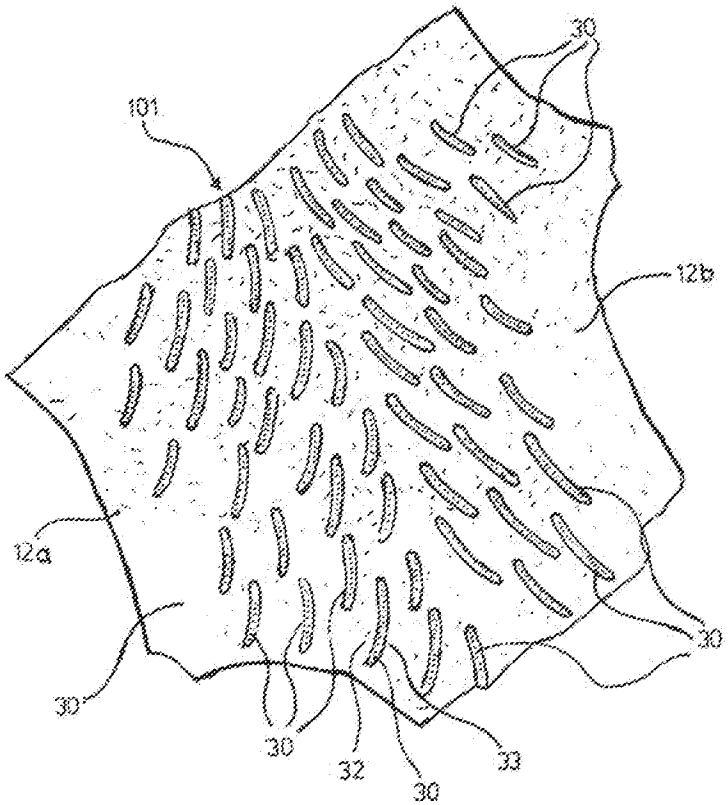
FIG. 4 shows a view, from the side of the first piece, of an elasticized structure according to the present disclosure, in accordance with a variation of embodiment.
Figure 6:
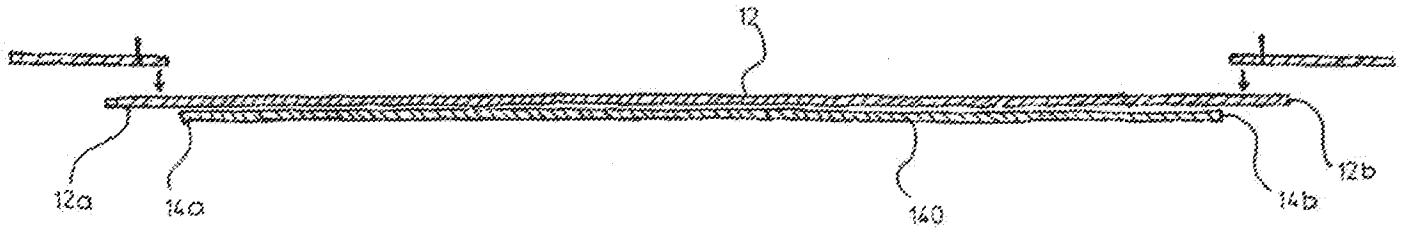
FIGS. 6 to 11 show, in a cross-sectional side view, successive processing steps for obtaining an elasticized structure according to the present disclosure.
Figure 7:
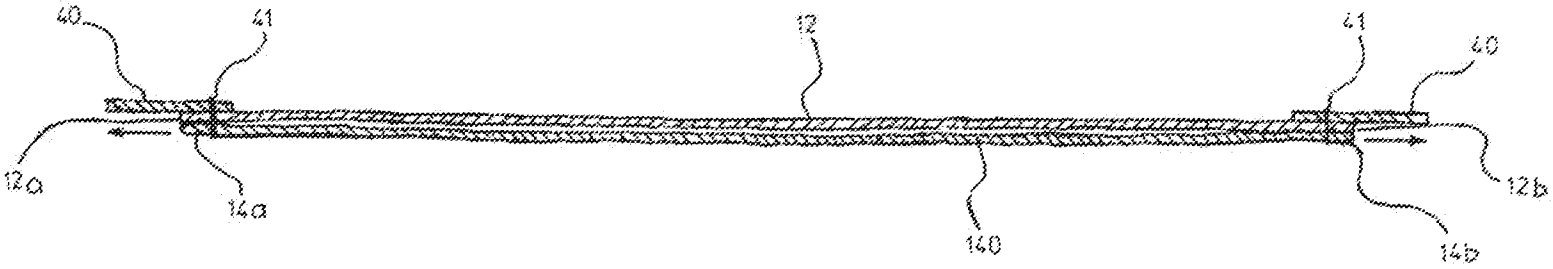
Figure 8:
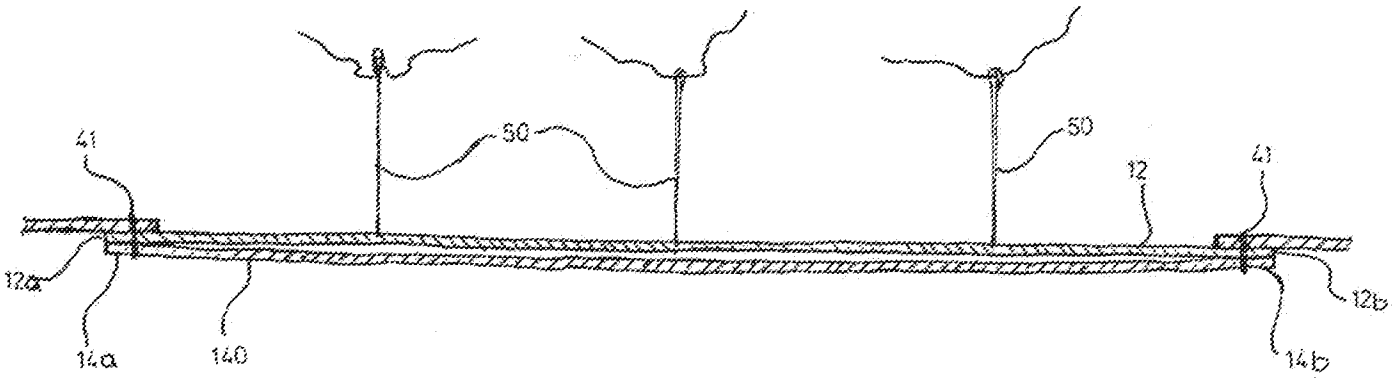
Figure 9:
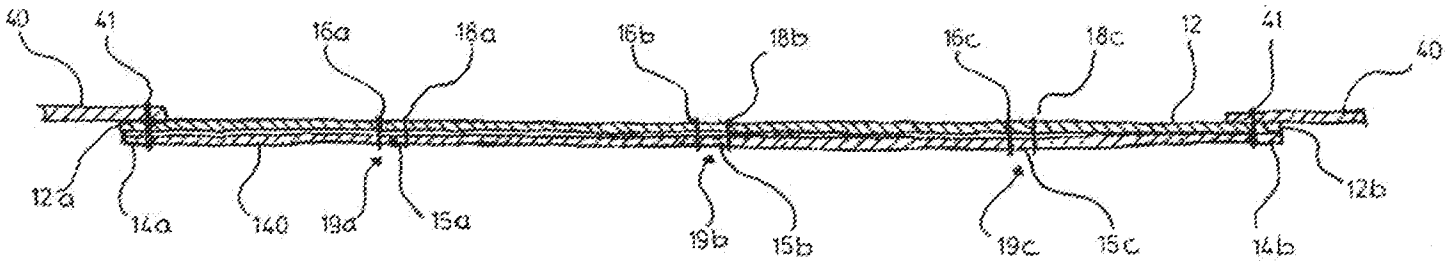
Figure 10:
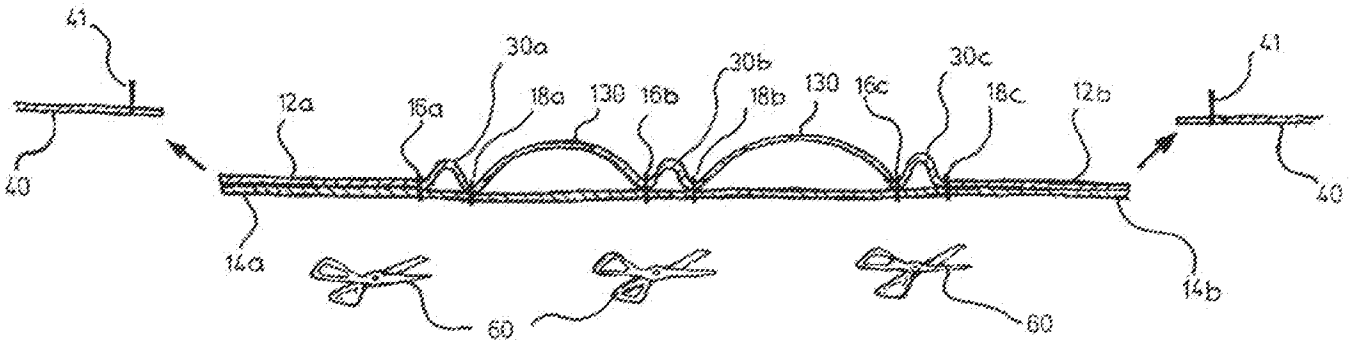
Figure 11:
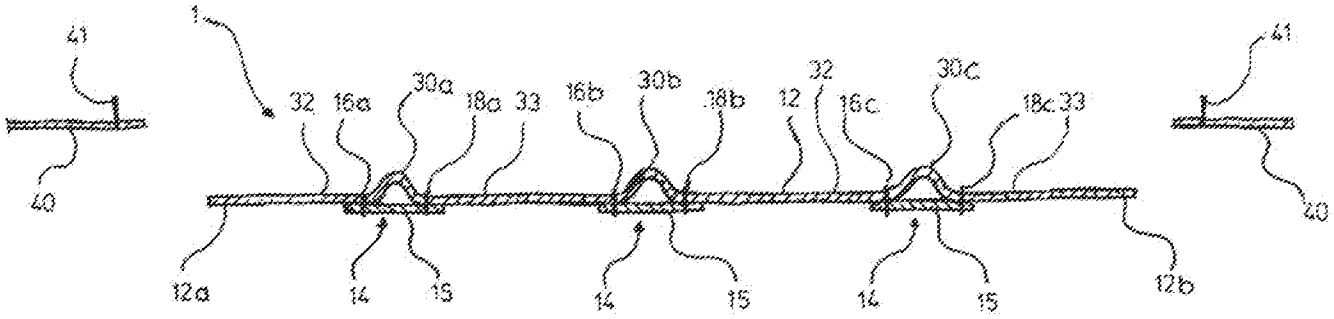
Figure 12:
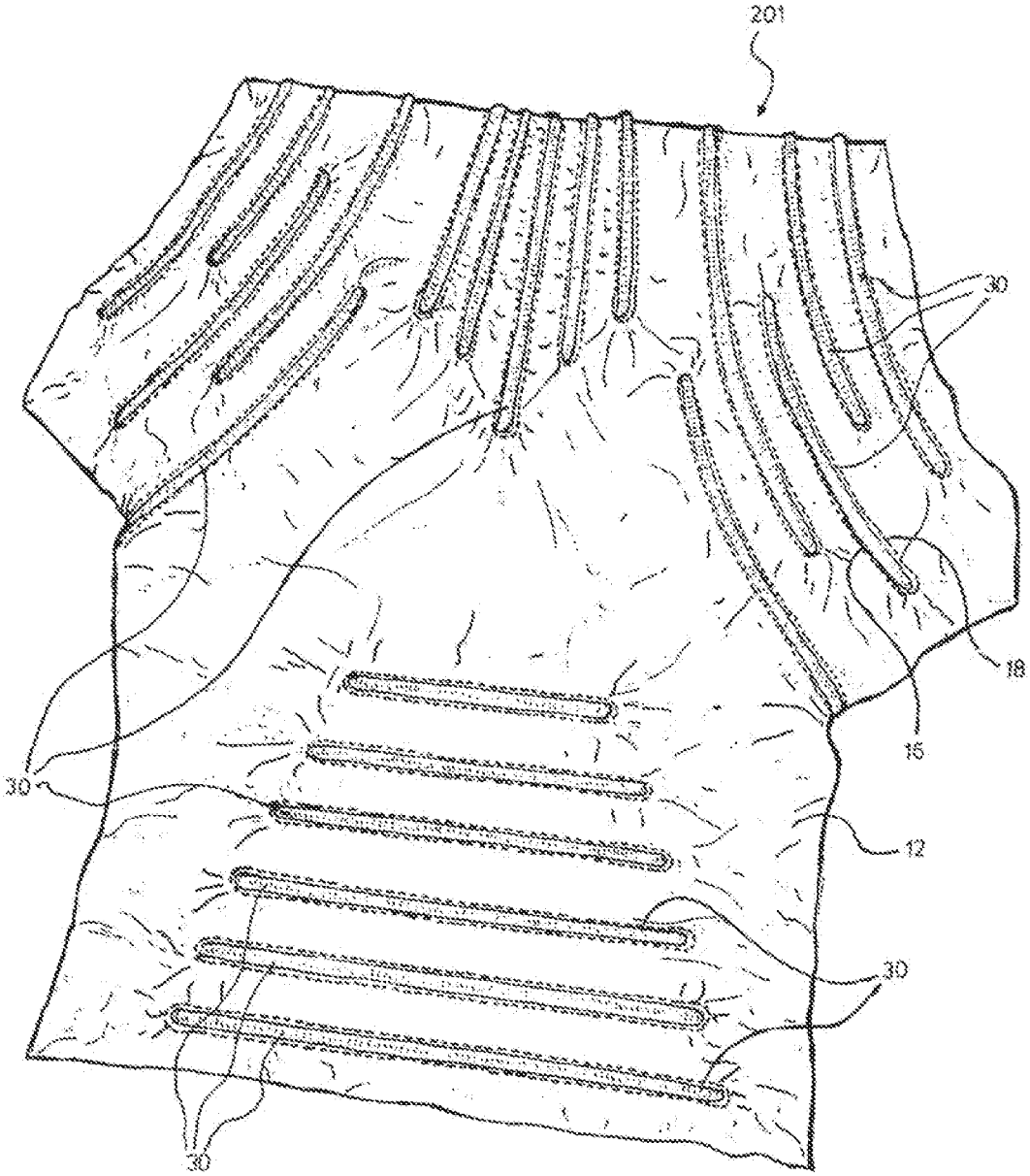
FIG. 12 shows a view, from the side of the first piece side, of an elasticized structure according to the present disclosure, in accordance with a further variation of embodiment.

Further elasticized structures according to the present disclosure are denoted, for example, in FIGS. 4 and 5 by the reference number 101 and in FIG. 12 by the reference number 201.

The elasticized structures 1, 101, 201 share the same structural features and differ from each other only in terms of a different design, i.e. the external aspect, this having no impact on the inventive idea forming the basis of the present disclosure. Moreover, the elasticized structures 1, 101, 201 can be obtained by means of the same method forming the subject of the present disclosure.

For that reason, hereinafter in the description, for simplicity's sake, reference will be made only to the elasticized structure 1, it being understood that the same considerations may be applied also to the elasticized structures 101 and 201.

Specifically, the elasticized structure 1 is particularly suitable for being used in a garment, such as a motorcycle suit, in particular in zones of the garment where a particular adherence of the garment to a zone of the body is needed.

Figure 1:
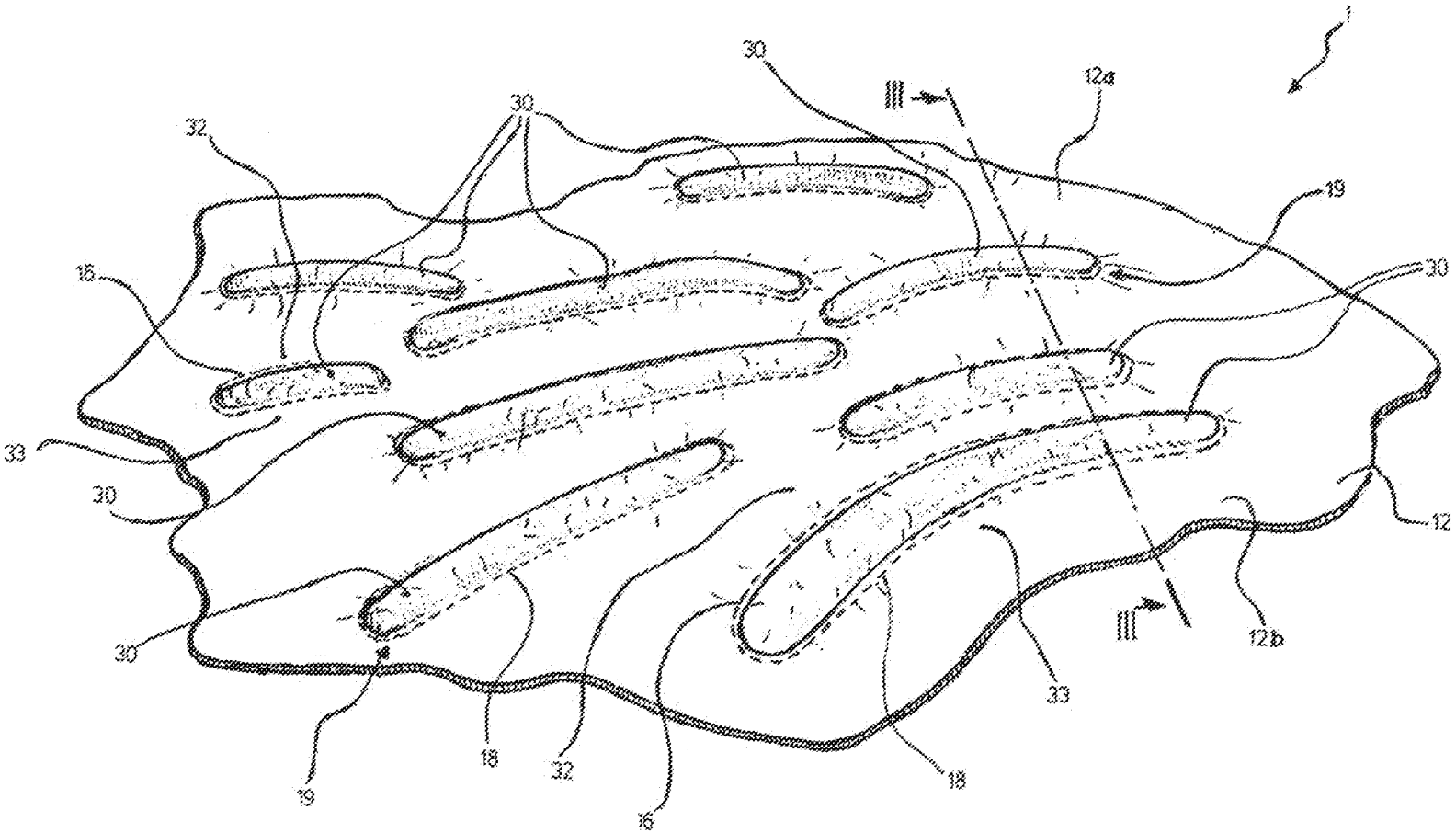
FIG. 1 shows a view, from the side of the first piece, of an elasticized structure according to the present disclosure.
Figure 2:
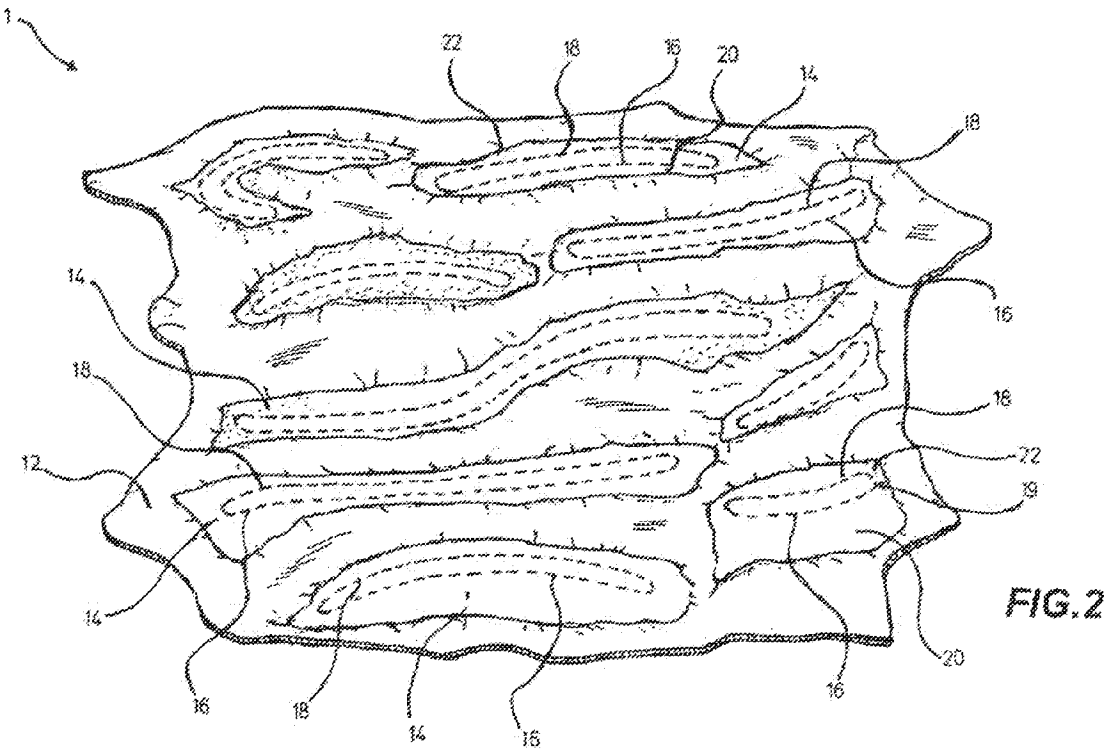
FIG. 2 shows a view, from the side of the second pieces, of an elasticized structure according to the present disclosure.
Figure 3:
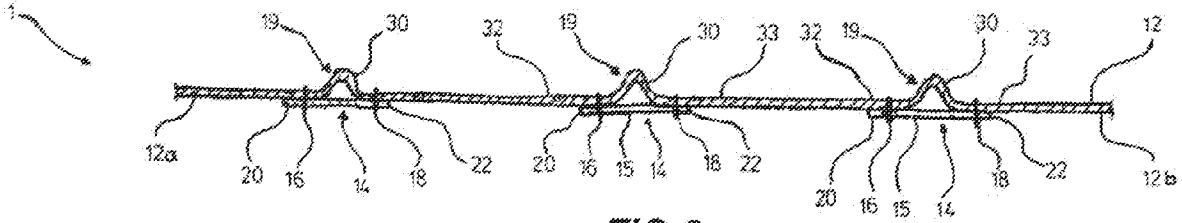
FIG. 3 shows a cross-sectional view along the line III-III of FIG. 1.

In particular, as can be seen from FIGS. 1, 2 and 3, the elasticized structure 1 includes a first piece 12, in the example made of leather, which, when in place or in use in a motorcycle suit, is located on an external or exposed side, and includes moreover a second piece 14, more particularly a plurality of second pieces 14 structurally and individually independent of each other, each at least partially made of an elastic material, in the example made of an elastic fabric, which, when in use or in place, are located on an internal side, hidden from view.

As can be seen, the first piece 12 has a greater surface area than the plurality of second pieces 14, and the second pieces 14 are detached from each other, i.e. are not connected.

Even more particularly, the first piece 12 is superimposed and fixed onto each second piece 14 in a first fixing zone 16 and in a second fixing zone 18 adjacent and opposite to the first fixing zone 16.

In the example, the first fixing zone 16 and the second fixing zone 18 are each part of a loop-shaped closed seam 19, i.e. they are opposite portions of a single loop-shaped closed seam 19.

Therefore, in the example, the first piece 12 is superimposed and fixed onto each second piece 14 by means of a seam 19, that defines at least a first fixing zone 16 and an opposite second fixing zone 18.

On the inside of the circle or of the loop defined by the seam 19, between the first fixing zone 16 and the opposite second fixing zone 18, an internal zone of elastic deformation 15, or elastic stretching, of the second piece 14, is defined.

The second piece 14 protrudes laterally, with respect to said internal zone of elastic deformation 15, from the first fixing zone 16 and from the second fixing zone 18, so as to have a first external zone, in the example a first free edge 20 or divided edge projecting from the first fixing zone 16 and a second external zone, in the example a second free edge 22 or divided edge projecting from the second fixing zone 18. In other words, the first fixing zone 16 divides the internal zone of elastic deformation 15 from the first free edge 20, while the second fixing zone 18 divides the internal zone of elastic deformation 15 from the second free edge 22.

In the example, since it is a single loop-shaped closed seam 19, it can be stated that the second piece 14 has a peripheral edge which protrudes from the seam 19 and approximately follows the profile of the seam 19.

Moreover, it is pointed out that the seam 19 is formed in such a way that, when the second piece 14 is in an undeformed condition (i.e. it is not subject to an elastic deformation), the first piece 12 is in a rest position and forms a hump 30, or fold or protrusion or curvature, between the first fixing zone 16 and the second fixing zone 18 (i.e. opposite the above-mentioned zone of elastic deformation 15).

On the sides of each hump 30 there are substantially flat parts 32, 33.

This relationship between the first piece 12 and each second piece 14 allows the first piece 12 to be tensioned in a working or stretched position, for example taking the first piece 12 in the region of peripheral borders 12*a*, 12*b* and pulling it so as to obtain a slackening of each hump 30 and a corresponding elastic deformation of each second piece 14.

Upon releasing of the tension acting on the first piece 12, each second piece 14 elastically returns into an undeformed condition and the first piece 12, owing to the constraint imposed by fixing of the seam 19, forms again the hump 30 and the flat parts 32, 33. In fact, the first piece 12, in the region of the second piece 14, is pulled along by the second piece 14 itself, so as to pucker and form the hump 30.

As it can be understood, when the first piece 12 is in the working tensioned condition, only the internal zone 15 of the second piece 14 is subject to an elastic deformation, while the first external zone (first free edge 20) and the second external zone (first free edge 22) are loose in an undeformed condition and thus they are not elastically dependent on the other second pieces 14.

In the example shown, an elasticized structure 1 is therefore provided so as to include a plurality of second pieces 14 structurally independent of each other; moreover, when a second piece 14 is in a deformed condition, there is also a slackening of the corresponding hump 30 of the first piece 12, whereas, when the second piece 14 returns into an undeformed condition, it locally pulls along the first piece 12, owing to the constraint imposed by the seam 19, so as to form the hump 30 between the respective first fixing zone 16 and the respective second fixing zone 18, and the flat parts 32, 33.

The elasticized structure 1 described above allows, owing to the structural independence of each second piece 14 from the other second pieces 14, the humps 30 of each second piece 14 to be separated from the flat parts 32, 33 and to be formed with a variable arrangement and distribution, also spread out and/or with different orientations, according to needs, and according to the aesthetic effect to be obtained. Examples of different distributions or different designs in relation to the distribution of the seams 19 and the humps 30 are shown, for example, in FIGS. 4 and 5 and in FIG. 12.

Moreover, the elasticized structure 1 thus obtained also allows a single hump 30 to be provided in a zone of a garment where a better adherence is needed, where the presence of a single hump 30 may have a low visual impact without modifying noticeably the exterior appearance of the garment.

Moreover, since it is possible to spread out at a distance from each other the humps 30, it is not necessary to thin the leather and it is possible to use as first piece 12 a leather with a thickness great enough to guarantee an adequate protection, for example suitable for use in a motorcycle suit.

Moreover, the elasticized structure 1 thus obtained allows the humps 30 to be formed in a zone of a motorcycle suit where a rigid protection element is located. The presence of the elasticized structure 1 is able to improve the adherence of the rigid protection element to the body of the user (where necessary adapting the size of the suit) and keep the rigid protection element in a fixed position with respect to the user him/herself, so as to guarantee an improved protection in the event of a fall.

Figure 13:
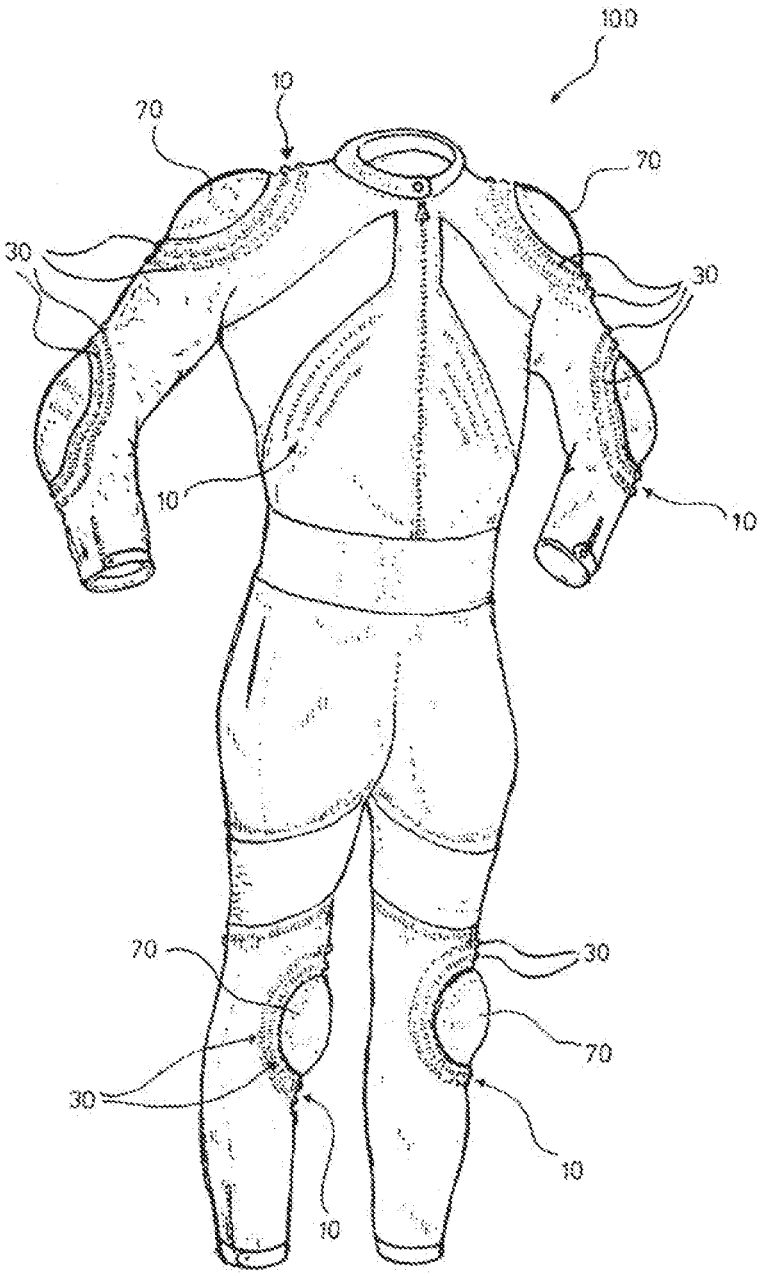
FIG. 13 shows a view of a motorcycle suit with one or more elasticized structures according to the present disclosure.

For example, FIG. 13 shows a garment, in the example a motorcycle suit 100 including a plurality of elasticized structures 10 according to the present disclosure, in the region of rigid protection elements 70 of the shoulders, knees and elbows. Each elasticized structure 10 includes a first piece, which forms the external leather layer of the motorcycle suit 100 and a plurality of internal non-visible second pieces 14, opposite the humps 30. Such elasticized structures 10 ensure the adherence of the rigid protection elements 70 and therefore improve the protection.

Some elasticized structures 10 are located, in the example, also in the stomach region.

Figure 14:
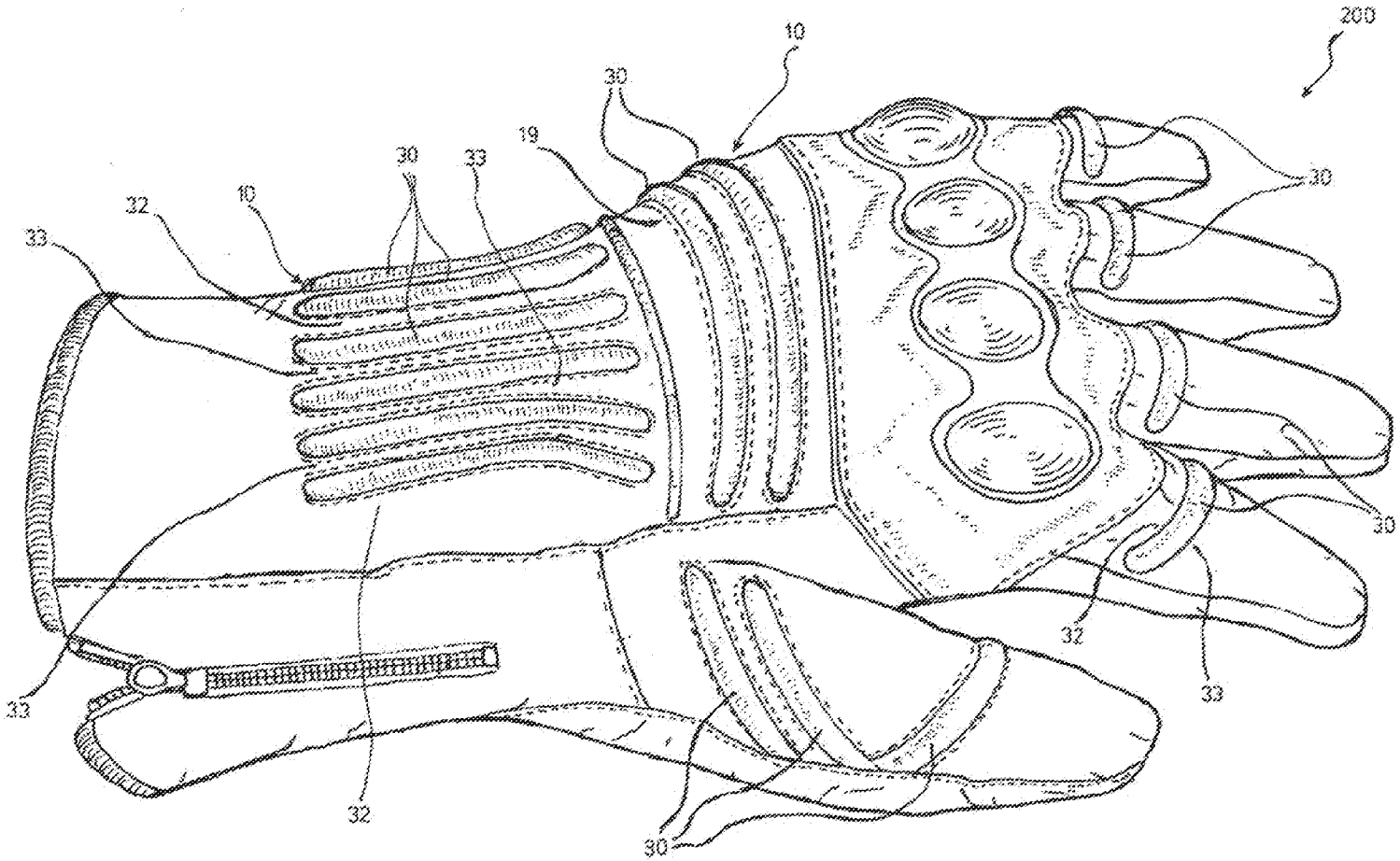
FIG. 14 shows a glove provided with one or more elasticized structures according to the present disclosure.

FIG. 14 shows another clothing item, i.e. a glove 200 including a plurality of elasticized structures 10 according to the present disclosure, arranged on the back of the hand and the fingers. Each elasticized structure 10 includes a first piece which forms the external leather layer of the glove 200 and a plurality of internal non-visible second pieces 14, opposite the humps 30. It is possible to note that a hump 30 is provided on each knuckle of the fingers of the glove 200. Such elasticized structures 10 ensure adherence of the glove 200 also in very small zones, such as the fingers or the knuckles of a hand. Moreover, owing to the seam 19, it is possible to obtain humps 30 with a desired design, such as the design consisting of a long profile, like that of FIG. 1, or the design consisting of long strips, like that of FIG. 12. Moreover, it is possible to obtain an elasticized structure 1 where the flat regions or flat parts 32, 33 are located between the humps 30, in other words the humps 30 rise up like "islands" in a plane or from a substantially flat zone.

A method used to make an elasticized structure, such as the elasticized structure 1, 101, 201 according to the present disclosure, is shown in FIGS. 6 to 11.

In the description of such method, elements and parts of the method which have the same function and the same structure as the elements and parts of the embodiment of the elasticized structure previously described retain the same reference number and are not described again in detail.

In particular, the method initially envisages preparing a first piece 12 made of leather and preparing a layer 140 made of an elastic material, i.e. a panel or strip with elastic properties, in the example a layer made of an elastic fabric.

As can be seen from the Figures, the first piece 12 has a greater surface area than the layer 140.

Subsequently, the layer 140 is stretched (i.e. elastically deformed) and the first piece 12 is superimposed on said layer. At this point, peripheral edges 12*a*, 12*b*, 14*a*, 14*b* of the first piece 12 and the layer 140 are laterally fixed on a support frame 40, provided with respective fixing pins 41. In the example shown in the Figures, in can be noted that, keeping the layer 140 and the first piece 12 in a superimposed condition, first peripheral edges 12*a*, 14*a* of the first piece 12 and of the layer 140, respectively, are fixed by means of a first pin 41 and second opposite peripheral edges 12*b*, 14*b* of the first piece 12 and of the layer 140 are fixed by means of another pin 41.

Further fixing pins 41, not shown in the Figures, are arranged along the whole perimeter of the first piece 12 and the layer 140.

In practice, in the supermposed condition, the layer 140 made elastic material is stretched so as to be fixed with the first piece 12 to the frame 40 in a deformed condition.

In a following step a plurality of seams 19, in the example denoted by the reference numbers 19*a*, 19*b*, 19*c*, are formed. The sewing step is shown, schematically, by means of needles 50, however it is understood that the seam or similar fixing system, for example gluing or thermoforming, may be performed by means of any conventional technique or conventional machine that allow joining together of the first piece 12 and the layer 140.

For every seam 19, a first fixing zone 16 and a second fixing zone 18 adjacent to the first fixing zone 16 are obtained.

Then (FIG. 10), the structure formed by the first piece 12 and by the layer 140 is removed from the frame 40. Detachment from the frame 40 results, in practice, in cessation of a deforming action acting on the layer 140; the layer 140 therefore elastically returns into an undeformed condition.

The elastic return of the layer 140 causes a wrinkling of the first piece 12, with the formation of a plurality of first humps 30*a*, 30*b*, 30*c*, and second humps 130.

In particular, the term "first hump 30*a*, 30*b*, 30*c*" refers to the fold that is comprised between the respective first fixing zone 16*a*, 16*b*, 16*c* and the respective second fixing zone 18*a*, 18*b*, 18*c*, opposite the above-mentioned internal zone of elastic deformation 15, with reference to the same seam 19*a*, 19*b*, 19*c*.

The term "second hump 130" refers to the fold that is comprised between the second fixing zone 18*a*, 18*b*, 18*c* of a seam 19*a*, 19*b*, 19*c* and the first fixing zone 16*a*, 16*b*, 16*c* of an adjacent seam 19*a*, 19*b*, 19*c*.

In a following step, the layer 140 is cut opposite each second hump 130, approximately following externally (i.e. on the external part of the zone of elastic deformation 15) the perimeter of the seams 19*a*, 19*b*, 19*c*, so as to obtain a plurality of second pieces 14 located only opposite the first hump 30*a*, 30*b*, 30*c*, i.e. second pieces 14 each having a free and cut edge 20, 22, which projects (externally with respect to the internal zone of elastic deformation 15) from the first fixing zone 16*a*, 16*b*, 16*c* and from the second fixing zone 18*a*, 18*b*, 18*c*. The second pieces 14 correspond to respective portions of the layer 140 and, after the cutting step, are structurally independent of each other.

The cutting step is denoted schematically by means of scissors 60, however it is understood that the cutting or similar dividing step may be performed by means of any conventional technique or machine that allow the structural integrity of the layer 140 to be interrupted.

This therefore results in an elasticized structure 1 having a localized elasticity, present only in a zone of elastic deformation 15, comprised between each first fixing zone 16 and each second fixing zone 18.

According to a variation of embodiment, the cutting step may be performed initially near the peripheral edges 12*a*, 14*a*, 12*b*, 14*b* so as to remove firstly from the support frame 40 the first piece 12 and the layer 140, and then proceed to divide the second pieces 14.

In a further variation of embodiment, the step of cutting the layer 140 is performed when the first piece 12 and the layer 140 are still mounted on the frame 40, i.e. when the layer 140 is elastically deformed and the first piece 12 does not have humps.

The examples set forth above are provided to give persons of ordinary skill in the art a complete disclosure and description of how to make and use the embodiments of the disclosure and are not intended to limit the scope of what the inventors regard as their disclosure. Modifications of the above-described modes for carrying out the disclosure may be used by persons skilled in the art and are intended to be within the scope of the following claims. All patents and publications mentioned in the specification may be indicative of the levels of skill of persons skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural references unless the content clearly dictates otherwise. The term "plurality" includes two or more references unless the content clearly dictates otherwise. Unless defined otherwise, all technical and scientific terms used herein have the same meaning as commonly understood by a person of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

What is claimed is:

1. An elasticized structure, including a first piece and at least one second piece, said first piece being superimposed and fixed onto the second piece in at least a first fixing zone and in at least a second fixing zone, said at least a second fixing zone being adjacent or neighboring to the at least a first fixing zone, wherein the second piece is at least partially made of elastic material, said second piece having an internal zone comprised between the first fixing zone and the second adjacent fixing zone, wherein said elasticized structure is able to assume a tensioned position and a rest position, wherein, in said tensioned position, the first piece is in an at least partially tensioned position and the internal zone of the second piece is in a condition of elastic deformation, and wherein, in said rest position, the first piece has only a single hump between the first fixing zone and the second adjacent fixing zone and parts which are flat, or without humps, alongside said first fixing zone and said second adjacent fixing zone, respectively.

2. An elasticized structure, including a first piece and at least one second piece, said first piece being superimposed and fixed onto the second piece in at least a first fixing zone and at least a second fixing zone, said at least a second fixing zone being adjacent or neighboring to the at least a first fixing zone, wherein the second piece is at least partially made of elastic material, said second piece having an internal zone comprised between the first fixing zone and the second adjacent fixing zone, wherein said elasticized structure is able to assume a rest position and a tensioned position, wherein, in said rest position, the second piece is undeformed and the first piece has only a single hump between the first fixing zone and the second adjacent fixing zone and parts which are flat, or without humps, alongside said first fixing zone and said second adjacent fixing zone, respectively, and wherein, in said tensioned position, the first piece is in an at least partially tensioned condition and the second piece has an elastic deformation confined to the internal zone.

3. The elasticized structure according to claim 1, wherein said second piece has externally projecting free edges alongside said first fixing zone and alongside said second adjacent fixing zone.

4. The elasticized structure according to claim 1, wherein said the first fixing zone and the second adjacent fixing zone extend along a closed line.

5. The elasticized structure according to claim 1, wherein the first fixing zone and the second adjacent fixing zone are a seam.

6. The elasticized structure according to claim 1, further comprising a closed seam defining a loop, wherein portions of said closed seam are said first fixing zone and second adjacent fixing zone.

7. The elasticized structure according to claim 6, wherein the second piece has a free peripheral edge projecting peripherally from said closed seam.

8. The elasticized structure according to claim 1, further comprising a plurality of said second pieces, said second pieces being structurally independent of each other.

9. The elasticized structure according to claim 1, wherein the first piece is made of leather.

10. A method for making the elasticized structure of claim 1, the method comprising the steps of providing a first piece and a layer made of an at least partially elastic material;

stretching the layer until the layer assumes an elastically deformed condition;

keeping the layer in a deformed condition, superimposing and joining together the first piece and the layer so as to obtain a first fixing zone and a second fixing zone, an internal zone being comprised between said first fixing zone and said second fixing zone; and cutting said layer alongside the first fixing zone and alongside the second fixing zone, externally to said internal zone, so as to obtain a second piece having a free edge projecting from the first fixing zone and a free edge projecting from the second fixing zone and so as to produce the elasticized structure of claim 1.

11. The method according to claim 10, wherein, during the step of joining together the first piece and the layer, a plurality of pairs of fixing zones are formed, each pair including a first fixing zone and wherein, during the cutting step, the layer is cut alongside each first fixing zone and alongside each second fixing zone, externally to the respective internal zone, so as to obtain a plurality of second pieces structurally independent of each other.

12. The method according to claim 10, wherein fixing of the first piece to the layer is carried out by means of a seam.

13. The method according to claim 10, wherein fixing of the first piece to the layer is carried out by following a closed line, where the first fixing zone and the second fixing zone are sections of said closed line.

14. The method according to claim 10, wherein, prior to fixing the first piece and the layer in the first fixing zone and the second fixing zone, the first piece and the layer are clamped together along respective edges, on a support frame, and wherein, after fixing, the first piece and the layer are removed from the support frame.

15. The method according to claim 14, wherein the cutting step is carried out after removing the first piece and the layer from the support frame.

16. The method according to claim 10, wherein the first piece is made of leather.

17. An elasticized structure which can be obtained according to a method according to claim 10.

18. A clothing item including an elasticized structure according to claim 1.

19. A clothing item including an elasticized structure according to claim 2.

* * * * *